US006692208B1

(12) United States Patent
Watkiss et al.

(10) Patent No.: US 6,692,208 B1
(45) Date of Patent: Feb. 17, 2004

(54) METHOD OF AND APPARATUS FOR PRODUCING BOOKLETS

(75) Inventors: Christopher Robin Watkiss, Biggleswade (GB); Robert Antony MacGregor, Milton Keynes (GB)

(73) Assignee: Watkiss Automation Limited (GB)

( * ) Notice: Subject to any disclaimer, the term of this patent is extended or adjusted under 35 U.S.C. 154(b) by 201 days.

(21) Appl. No.: 09/684,020

(22) Filed: Oct. 6, 2000

(30) Foreign Application Priority Data

Mar. 7, 2000 (GB) ..... 0005333

(51) Int. Cl.[7] ..... B42B 5/00

(52) U.S. Cl. ..... 412/1; 156/479; 270/58.08; 271/99; 281/21.1; 412/4; 412/8; 412/9; 412/22

(58) Field of Search ..... 412/1, 3, 4, 5, 412/6, 8, 9, 19, 22, 23, 30, 37; 156/479, 908; 270/37, 52.18, 58.08; 271/99; 281/15.1, 21.1, 29

(56) References Cited

U.S. PATENT DOCUMENTS

| | | | | | |
|---|---|---|---|---|---|
| 2,066,620 | A | | 1/1937 | Grammer | 281/15 |
| 2,068,603 | A | | 1/1937 | Grammer | 281/21 |
| 2,088,904 | A | | 8/1937 | Grammer | 281/15 |
| 4,243,459 | A | * | 1/1981 | Lawes | 156/275.1 |
| 4,875,668 | A | | 10/1989 | Spyra | 270/45 |
| 5,221,112 | A | | 6/1993 | Holmberg | 281/21.1 |
| 5,672,030 | A | * | 9/1997 | Dean | 412/7 |
| 5,871,323 | A | * | 2/1999 | Clark | 412/19 |
| 5,941,671 | A | * | 8/1999 | Wehrle | 412/1 |
| 5,961,268 | A | * | 10/1999 | Jager | 412/1 |
| 6,142,721 | A | * | 11/2000 | Marsh | 281/21.1 |
| 6,168,363 | B1 | * | 1/2001 | Nehring | 412/22 |
| 6,199,851 | B1 | * | 3/2001 | Latvakangas et al. | 270/37 |
| 6,250,867 | B1 | * | 6/2001 | Gwyn et al. | 281/15.1 |
| 6,338,603 | B1 | * | 1/2002 | Cerruti | 270/52.08 |

FOREIGN PATENT DOCUMENTS

| | | | |
|---|---|---|---|
| EP | 0 034 921 | | 9/1981 |
| EP | 0 107 424 | | 5/1984 |
| EP | 0 153 983 | | 9/1985 |
| EP | 0 614 841 | A1 | 9/1994 |
| EP | 0 741 097 | A2 | 11/1996 |
| EP | 0 945 384 | A1 | 9/1999 |
| EP | 0 945 386 | A1 | 9/1999 |
| GB | 1121493 | | 7/1968 |
| GB | 2 031 798 | A | 4/1980 |
| JP | 2001-260564 | * | 9/2001 |
| WO | WO 94/29117 | | 12/1994 |
| WO | WO 97/17209 | | 5/1997 |

OTHER PUBLICATIONS

GB 0017939.0 Search Report dated Oct. 16, 2000.

* cited by examiner

*Primary Examiner*—Monica Carter
(74) *Attorney, Agent, or Firm*—Woodcock Washburn, LLP

(57) ABSTRACT

A booklet of sheets folded to create a curved spine is fixedly held by clamping jaws adjacent to the spine and a forming roller is passed one or more times along the length of the protruding spine with sufficient pressure to produce a flattening of the curvature of the spine. The deformation of the spine of the booklet means that the sheets lie flat after the treatment. A retractable stop plate defines the amount by which the spine protrudes beyond the jaws.

22 Claims, 2 Drawing Sheets

FIG. 1
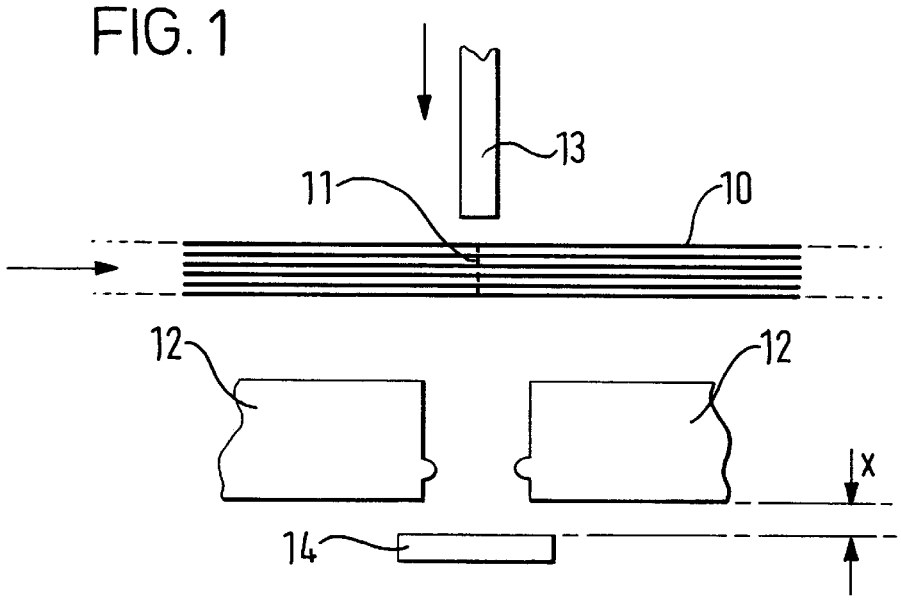
FIG. 2
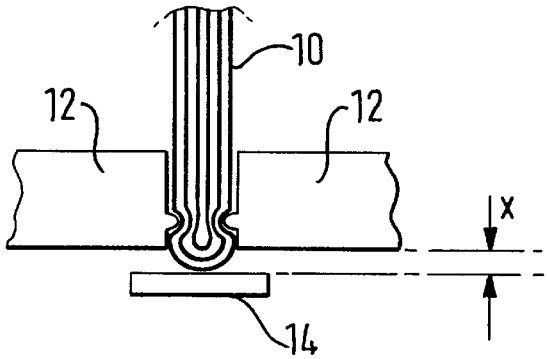
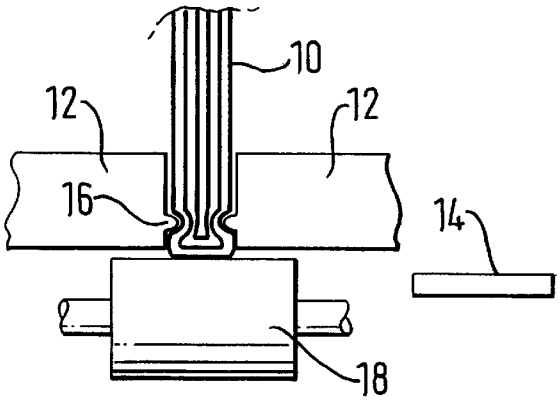
FIG. 3

METHOD OF AND APPARATUS FOR PRODUCING BOOKLETS

FIELD OF THE INVENTION

This invention relates generally to methods of and apparatus for producing booklets and the like, and is also concerned with booklets and the like when produced by these methods. The term "booklet" used hereinafter is intended to cover any set of folded sheets which are stitched or stapled along an axis, which are glued, or which are simply folded. The term "booklet" is therefore intended to include items such as brochures, pamphlets, manuals and the like.

DESCRIPTION OF THE PRIOR ART

Customarily, the folding of a set of up to perhaps 30 or so sheets in a stitcher/folder machine results in the finished product having a distinct bow adjacent to the spine. This means that the booklet tends to open out, giving it a less attractive appearance, and also making it more difficult to stack a number of such booklets for storage and transportation purposes because they will not lie "flat". One cannot stack a large number of such booklets all with the spine on the same side, because the stack becomes lop-sided. One has to stack the booklets with some spines on one side and some on the other, in order to equalise the stack.

A number of different forms of apparatus are known which are concerned with improving the fold of a set of sheets, usually by the use of a creasing device. GB2031798A shows the use of "smoothing arms" which have surfaces which press against the spine of the book, but not in a sense to deform the spine. The purpose of the smoothing arms in GB2031798A is to smooth material accumulations around the stitching holes and to prevent the entry of glue through the stitching holes into the interior of the book.

SUMMARY OF THE INVENTION

It is an object of the present invention to provide methods of and apparatus for treating such booklets so that the sheets will lie flat after treatment.

It is a further object of the present invention to provide methods of and apparatus for treating such booklets in which the spine of the booklet is deformed so that the sheets will lie flat after treatment.

In accordance with the present invention there is provided a method of treating a booklet of sheets folded to create a curved spine which comprises the steps of fixedly holding the folded booklet adjacent to the spine to create a protruding portion, and passing a forming means along the length of the protruding portion with sufficient pressure to produce a flattening of the curvature of the spine.

Preferably, the forming means is a pressure roller which is caused to undergo one or more passes along the length of the spine.

The amount by which the spine of the booklet protrudes clear of means by which it is fixedly held is adjustable so that this dimension can be varied in dependence inter alia on the number of sheets in the booklet and the material of which the sheets are composed. The amount of protrusion is preferably from 0.5 mm to 1.75 mm.

In a preferred embodiment of the invention the booklet is held clamped by jaws, which may be ribbed to improve their grip, which engage the booklet adjacent to the spine.

Also in accordance with the present invention there is provided apparatus for treating a booklet of sheets folded to create a curved spine, which comprises clamping means arranged fixedly to hold a set of folded sheets of material with a portion of the spine protruding from the clamping means, and forming means displaceable along the length of the protruding portion to exert pressure against the spine sufficient to produce a flattening of the curvature of the spine.

Preferably, the forming means comprises a roller which is arranged to be able to make one or more passes along the length of the spine.

In a preferred embodiment the clamping means comprises a pair of jaws, possibly ribbed, which are arranged to grip the folded sheets adjacent to the spine.

Also in accordance with the invention there is provided a booklet comprising a plurality of sheets of material folded about an axis and having the spine of the booklet deformed to a flattened shape.

BRIEF REFERENCE TO THE DRAWINGS

In order that the invention may be more fully understood, one presently preferred embodiment in accordance with the invention will now be described by way of example and with reference to the accompanying drawings. In the drawings:

FIG. 1 illustrates the insertion of a set of sheets into the clamping jaws;

FIG. 2 illustrates the clamping jaws closed onto the folded sheets;

FIG. 3 illustrates the passage of a roller to deform the spine;

DESCRIPTION OF THE PREFERRED EMBODIMENT

Figure 4:
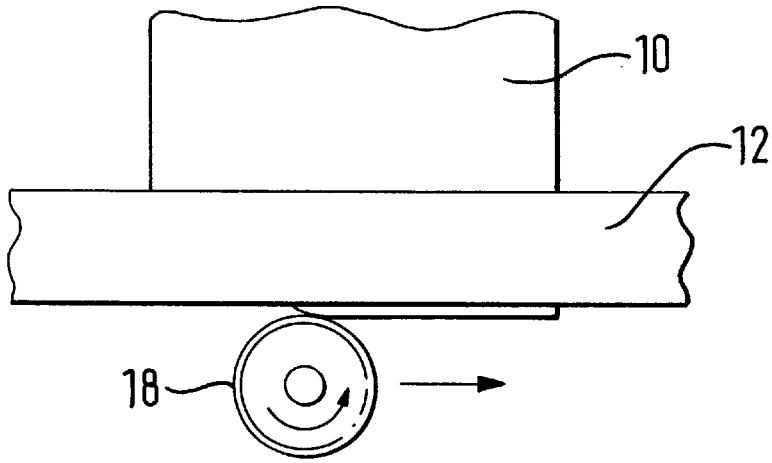
FIG. 4 is a side view of the parts illustrated in FIG. 3, showing the passage of the roller along the spine.

The apparatus shown in the drawings is shown only schematically, to illustrate the sequence of movements involved in carrying out this embodiment of the method of the invention.

As shown in FIG. 1, a plurality of sheets 10 of paper or other material stitched/stapled at, as indicated at 11, one or more positions along an axis to maintain the sheets in register is brought to a position above a pair of open clamping jaws 12. The clamping jaws 12 are elongate bars which extend the length of the set of sheets 10. Above the set of sheets is a displaceable blade 13, in alignment with the stitching 11, which by a downward movement will force the set of sheets down between the jaws 12, thereby folding the sheets about the stitching axis. Below the clamping jaws 12 is a stop plate 14 which limits the downward movement of the set of folded sheets when deposited between the jaws. When the spine of the sheets contacts the stop plate 14, the blade 13 is retracted upwards. Each of the clamping jaws 12 is provided with a longitudinally extending rib 16 which runs the length of the jaws. Alternatively, the facing surfaces of the jaws may be embossed or milled or provided with some other patterning to improve the grip. As shown most clearly in FIG. 2, the jaws engage and grip the set of folded sheets 10 when they are moved inwards to exert a clamping effect. Instead of moving both jaws 12 towards each other, one can alternatively have one jaw fixed and the other jaw movable towards and away from it. It is essential that the set of sheets 10 is firmly gripped by the clamping jaws to prevent any movement. The distance x between the upper surface of the stop plate 14 and the underside of the clamping jaws 12 is an important feature of the invention. This distance is adjustable, so that one can control the amount by which the set of folded sheets 10 protrudes below the jaws. As shown in FIG. 2, the protruding portion of the set of sheets is still convex in shape at this stage.

The amount of protrusion x will vary depending inter alia on the number of sheets 10 and the material of which they are composed. The sheets will normally be a paper material but the thickness, surface finish, etc. will vary and adjustment will need to be made to allow for this. A cover sheet of a different material may also have an effect. It has been found that a protrusion x of from 0.5 mm to 1.75 mm produces the optimum results under most circumstances, but it should be understood that these figures are preferred figures only and do not limit the scope of the invention.

If ribs 16 are provided on the jaws 12, then the distance between the ribs 16 and the upper surface of the stop plate 14 may be between approximately 5 mm and 10 mm.

As shown in FIGS. 3 and 4, when the set of sheets 10 has been firmly gripped by the clamping jaws 12, the stop plate 14 is retracted to one side and, either automatically or under the control of an operator, a forming roller 18 is arranged to travel the length of the clamping jaws, below the jaws, thereby compressing and deforming the convex spine of the sheets into a flattened shape. In its passage beneath the clamping jaws 12 the forming roller 18 is almost in contact with the jaws. This is an important feature in producing the required effect. The roller 18 thus exerts a substantial upward pressure against the spine of the folded sheets in its passage along the length of the jaws. Depending upon the number of sheets and the materials used, the roller 18 may make a single pass or more than one pass along the length of the spine in order to create the desired flattening of the spine.

Figure 5:
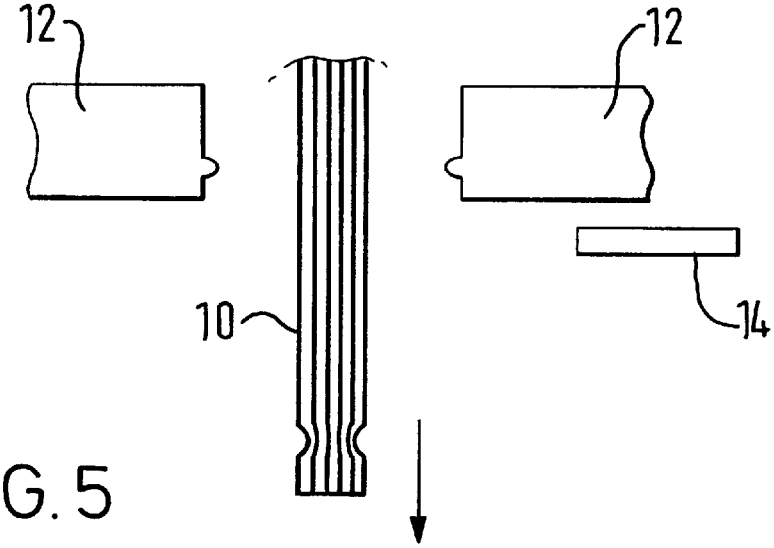
FIG. 5 shows the removal of the booklet after deformation of the spine.

When the roller 18 has performed its function it is returned to its inactive position at one end of the jaws and the jaws 12 are opened as shown in FIG. 5 to permit the booklet thus formed to be removed either downwards or alternatively upwards. If the booklet is to be removed upwards then after retraction of the roller 18 the stop plate 14 is moved back into position below the booklet before the clamping jaws 12 are opened. The booklet can then be lifted from the apparatus. It will be seen from FIG. 5 that the booklet when released from the jaws has a crease on front and back from the pressure of the ribs 16.

By flattening the spine of the booklet in this way, the resulting product will lie flat without appreciable bowing adjacent to the spine, hence facilitating subsequent storage and transportation of the booklets.

Although reference has been made above to the set of sheets 10 being stitched, i.e. stapled, together before insertion into the forming apparatus, the invention can also be carried out without the sheets being stitched. In the latter case, the set of sheets can be simply folded or one could use an adhesive, for example a pressure sensitive adhesive, which will secure the sheets together under the pressure which is generated. That would require the application of the adhesive to the sheets before the folded set of sheets is inserted between the clamping jaws.

Although not shown in the drawings, and not described in detail above, the sequence of steps which make up the method in accordance with the invention can be controlled by an operator or can be part of an automated system after the apparatus has been set up for a particular production run. The apparatus of the present invention can also be provided as an additional element of a booklet production apparatus. In producing booklets it is conventional to stitch, then to fold, and then to trim. The forming step of the present invention would desirably follow the folding operation and would be followed by the trimming operation. Trimming is preferably left until last, in case the forming operation causes any misalignment of the sheets.

While the present invention has been described with reference to a particular embodiment, those skilled in the art will recognize that many changes may be made thereto without departing from the spirit and scope of the present invention.

What is claimed is:

1. A method of treating a booklet of sheets folded to create a curved spine, comprising the steps of:

providing a booklet of folded sheets, the folded sheets having a spinal portion having a convex shaped end surface;

fixedly holding the folded sheets along their length adjacent to and along the length of the spinal portion and at a predetermined lateral distance therefrom to leave a protruding portion of the sheets, the protruding portion having a predetermined width and including the spinal portion;

providing a forming means;

causing the forming means to pass longitudinally of the protruding portion to apply to the spinal portion from one end thereof to the other a force in the lateral direction sufficient to produce a deformation of the protruding portion, the deformation comprising a flattening of the convex shaped end surface of the spinal portion of the booklet of folded sheets.

2. A method as claimed in claim 1, in which the forming means comprises a forming roller.

3. A method as claimed in claim 1, in which the forming means is caused to undergo a plurality of passes along the length of the spine.

4. A method as claimed in claim 1, including the step of adjusting the width of the protruding portion to attain the predetermined width.

5. A method as claimed in claim 1, in which the predetermined width is from 0.5 mm to 1.75 mm.

6. A method as claimed in claim 1, in which the booklet of folded sheets is held by clamping jaws.

7. A method as claimed in claim 6, in which the clamping jaws each have an elongate rib indenting the booklet of folded sheets.

8. A method as claimed in claim 7, in which the distance between the ribs and the surface of a stop plate against which the spine of the booklet rests prior to forming is in the range from 5 mm to 10 mm.

9. A method as claimed in claim 1, in which the folded sheets are stitched together before they are fixedly held.

10. A method as claimed in claim 1, in which a pressure sensitive adhesive is applied to the sheets before they are fixedly held.

11. A method as claimed in claim 1, in which the forming of the booklet is preceded by stitching of the folded sheets and is followed by a trimming operation.

12. A method of treating a booklet of sheets folded to create a curved spine, which comprises the steps of first depositing the folded sheets between a pair of open clamping jaws and into contact with a stop plate, then closing the jaws to fixedly hold the folded booklet adjacent to the spine to create a protruding portion, retracting the stop plate, passing a forming means along the length of the protruding portion with sufficient pressure to produce a flattening of the curvature of the spine, and opening the jaws to permit removal of the booklet.

13. A method of treating a booklet of sheets which are initially folded to create a curved spine, which comprises the steps of fixedly holding the folded booklet adjacent to the spine to create a protruding portion, and passing a forming means along the length of the protruding portion with sufficient pressure to produce a flattening of the curvature of the spine, in which the initial folding of the sheets is effected by displacement of a blade which acts on a flat set of sheets to fold them and deposit them into the position in which they are then fixedly held.

14. An apparatus for treating a booklet of sheets folded to create a curved spine, comprising:

clamping means for fixedly holding a booklet of folded sheets, the folded sheets having a spinal portion having a convex shaped end surface and the clamping means being arranged to hold the folded sheets along their length adjacent to and along the length of the spinal portion and at a predetermined lateral distance therefrom to leave a protruding portion of the sheets, the protruding portion having a predetermined width and including the spinal portion; and a forming means displaceable to pass longitudinally of the protruding portion to apply to the spinal portion from one end thereof to the other a force in the lateral direction sufficient to produce a deformation of the protruding portion, the deformation comprising a flattening of the convex shaped end surface of the spinal portion of the booklet of folded sheets.

15. An apparatus as claimed in claim 14, in which the forming means comprises a roller.

16. An apparatus as claimed in claim 14, in which the width of the protruding portion is adjustable.

17. An apparatus as claimed in claim 16, in which the predetermined width is from 0.5 mm to 1.75 mm.

18. An apparatus as claimed in claim 14, in which the clamping means comprises a pair of elongate jaws whose surfaces which engage the folded sheets are shaped or patterned to aid gripping engagement.

19. An apparatus as claimed in claim 18, in which each jaw has an elongate rib to aid gripping engagement.

20. An apparatus as claimed in claim 19, which further comprises a stop plate against which the spine of the booklet rests prior to forming, and wherein the distance between the ribs and the surface of the stop plate is in the range from 5 mm to 10 mm.

21. A method as claimed in claim 1, further comprising providing a stop plate against which the convex shaped end surface abuts to determine the width of the protruding portion, the stop plate being withdrawn to allow application of the forming means.

22. An apparatus as claimed in claim 14, further comprising a stop plate positionable to provide an abutment for the convex shaped end surface and thereby determine the width of the protruding portion, the stop being withdrawable to allow application of the forming means.

* * * * *